US005608438A

United States Patent [19]

Koike et al.

[11] Patent Number: 5,608,438

[45] Date of Patent: Mar. 4, 1997

[54] INK JET RECORDING METHOD AND APPARATUS

[75] Inventors: Takao Koike; Koichi Saito; Shinji Tabata; Koichi Naitoh, all of Kanagawa, Japan

[73] Assignee: Fuji Xerox Co., Ltd., Tokyo, Japan

[21] Appl. No.: 286,282

[22] Filed: Aug. 5, 1994

[30] Foreign Application Priority Data

Aug. 9, 1993 [JP] Japan ..... 5-197282

[51] Int. Cl.[6] ..... B41J 2/005; B41J 2/21

[52] U.S. Cl. ..... 347/100; 106/200

[58] Field of Search ..... 347/100; 106/20 D

[56] References Cited

U.S. PATENT DOCUMENTS 5,371,531 12/1994 Rezanka et al. ..... 347/43

FOREIGN PATENT DOCUMENTS 3-41171 2/1991 Japan .

4-364961 12/1992 Japan .

4-355157 12/1992 Japan .

6-122208 5/1994 Japan .

*Primary Examiner*—Benjamin R. Fuller

*Assistant Examiner*—Valerie Ann Lund

*Attorney, Agent, or Firm*—Oliff & Berridge

[57] ABSTRACT

An ink jet recording method uses a plurality of recording heads, each of which jets droplets of ink of water-soluble dye of different color to record an image on a recording medium. The recording method includes the steps of: jetting a first ink from one of the plurality of recording heads to print on the recording medium, the first ink having an absorption coefficient (Ka) of 0.5 $ml/m^2 \cdot ms^{1/2}$ or less and a wetting time (Tw) of 50 to 200 msec; and jetting a second ink from one of the plurality of recording heads to print on the recording medium, the second ink having an absorption coefficient (Ka) of 1.0 $ml/m^2 \cdot ms^{1/2}$ or larger and a wetting time (Tw) of 20 msec or less.

14 Claims, 19 Drawing Sheets

FIG. 6

COMPOSITION, PHYSICAL PROPERTIES, AND CHARACTERISTICS OF INKS OF EXAMPLE 1 AND COMPARISON 3
(FX-L paper manufactured by Fuji Xerox Co., Ltd.)

| | BLACK | CYAN | MAGENTA | YELLOW |
|---|---|---|---|---|
| Ink Compositions dye | 2.5 | 3.0 | 3.0 | 3.0 |
| DEG | 15.0 | 25.0 | 25.0 | 25.0 |
| Block Copolymer | - | 1.0 | 1.0 | 1.0 |
| Deionized Water | 82.5 | 71.0 | 71.0 | 71.0 |
| Viscosity (mP·s) | 1.8 | 2.7 | 2.3 | 2.5 |
| Surface Tension (mN/m) | 47 | 36 | 36 | 36 |
| Absorption Coefficient: Ka($ml/m^2 \cdot ms^{-1/2}$) | 0.2 | 3.0 | 2.8 | 2.8 |
| Wetting Time: Tw(ms) | 140 | 10 | 8 | 8 |

Block Copolymer: Copolymer of propylene oxide and ethylene oxide; and average molecular weight of the copolymer is 1700 and the content of ethylene oxide in the copolymer is 30%.

FIG. 7

COMPOSITION, PHYSICAL PROPERTIES, AND CHARACTERISTICS OF INKS OF COMPARISON 1
(FX-L paper manufactured by Fuji Xerox Co., Ltd.)

| | BLACK | CYAN | MAGENTA | YELLOW |
|---|---|---|---|---|
| Ink Compositions dye | 2.5 | 3.0 | 3.0 | 3.0 |
| DEG | 15.0 | 15.0 | 15.0 | 15.0 |
| Deionized Water | 82.5 | 82.0 | 82.0 | 82.0 |
| Viscosity (mP·s) | 1.8 | 1.7 | 1.8 | 1.9 |
| Surface Tension (mN/m) | 61 | 60 | 60 | 59 |
| Absorption Coefficient: Ka($ml/m^2 \cdot ms^{-1/2}$) | 0.2 | 0.2 | 0.3 | 0.2 |
| Wetting Time: Tw(ms) | 140 | 130 | 110 | 120 |

FIG. 8

COMPOSITION, PHYSICAL PROPERTIES, AND CHARACTERISTICS OF INKS OF COMPARISON 2
(FX-L paper manufactured by Fuji Xerox Co., Ltd.)

| | BLACK | CYAN | MAGENTA | YELLOW |
|---|---|---|---|---|
| Ink Compositions dye | 3.0 | 3.0 | 3.0 | 3.0 |
| DEG | 25.0 | 25.0 | 25.0 | 25.0 |
| Block Copolymer | 1.0 | 1.0 | 1.0 | 1.0 |
| Deionized Water | 71.0 | 71.0 | 71.0 | 71.0 |
| Viscosity (mP·s) | 2.6 | 2.7 | 2.3 | 2.5 |
| Surface Tension (mN/m) | 35 | 35 | 36 | 36 |
| Absorption Coefficient: Ka ($ml/m^2 \cdot ms^{-1/2}$) | 3.1 | 3.0 | 2.8 | 2.8 |
| Wetting Time: Tw (ms) | 12 | 10 | 8 | 8 |

Block Copolymer: Copolymer of propylene oxide and ethylene oxide; and average molecular weight of the copolymer is 1700 and the content of ethylene oxide in the copolymer is 30%.

FIG. 9

COMPOSITION, PHYSICAL PROPERTIES, AND CHARACTERISTICS OF INKS OF EXAMPLE 2
(FX-L paper manufactured by Fuji Xerox Co., Ltd.)

| | BLACK | CYAN | MAGENTA | YELLOW |
|---|---|---|---|---|
| Ink Compositions dye | 2.5 | 3.0 | 3.0 | 3.0 |
| DEG | 10.0 | 25.0 | 25.0 | 25.0 |
| Block Copolymer | - | 3.0 | 3.0 | 3.0 |
| Deionized Water | 87.5 | 69.5 | 69.0 | 69.0 |
| Viscosity (mP·s) | 1.6 | 4.0 | 3.8 | 4.0 |
| Surface Tension (mN/m) | 62 | 34 | 32 | 34 |
| Absorption Coefficient: Ka($ml/m^2 \cdot ms^{-1/2}$) | 0.4 | 2.5 | 2.7 | 2.6 |
| Wetting Time: Tw(ms) | 120 | 8 | 10 | 6 |

Block Copolymer: Copolymer of propylene oxide and ethylene oxide; and average molecular weight of the copolymer is 1700 and the content of ethylene oxide in the copolymer is 30%.

FIG. 10

COMPOSITION, PHYSICAL PROPERTIES, AND CHARACTERISTICS OF INKS OF EXAMPLE 3
(FX-L paper manufactured by Fuji Xerox Co., Ltd.)

| | BLACK | CYAN | MAGENTA | YELLOW |
|---|---|---|---|---|
| Ink Compositions dye | 2.5 | 3.0 | 3.0 | 3.0 |
| DEG | 20.0 | 10.0 | 10.0 | 10.0 |
| Triethanol Amine | - | 5.0 | 5.0 | 5.0 |
| Block Copolymer | - | 3.0 | 3.0 | 3.0 |
| Deionized Water | 77.5 | 79.0 | 79.0 | 79.0 |
| Viscosity (mP·s) | 2.0 | 2.8 | 2.7 | 2.6 |
| Surface Tension (mN/m) | 57 | 35 | 36 | 35 |
| Absorption Coefficient: Ka($ml/m^2 \cdot ms^{-1/2}$) | 0.2 | 4.5 | 4.2 | 3.9 |
| Wetting Time: Tw(ms) | 150 | 5 | 6 | 5 |

Block Copolymer: Copolymer of propylene oxide and ethylene oxide; and average molecular weight of the copolymer is 3000 and the content of ethylene oxide in the copolymer is 40%.

FIG. 11

EVALUATION OF PRINT RESULTS OF EXAMPLES AND COMPARISONS

| | EXAMPLE 1 | COMP. 1 | COMP. 2 | COMP. 3 | EXAMPLE 2 | EXAMPLE 3 |
|---|---|---|---|---|---|---|
| CHARACTER QUALITY | GOOD | GOOD | POOR | GOOD | GOOD | GOOD |
| LINE QUALITY | GOOD | GOOD | POOR | GOOD | GOOD | GOOD |
| DENSITY | GOOD | GOOD | MODERATE | GOOD | GOOD | GOOD |
| INTERCOLOR SPREAD | GOOD | POOR | GOOD | MODERATE OR POOR | GOOD | GOOD |

FIG. 12

COMPOSITION, PHYSICAL PROPERTIES, AND CHARACTERISTICS OF INKS OF EXAMPLE 4 AND COMPARISON 4
(FX-L paper manufactured by Fuji Xerox Co., Ltd.) Vr = 7.5 (25°C)

| | BLACK | CYAN | MAGENTA | YELLOW |
|---|---|---|---|---|
| Ink Compositions dye | 2.5 | 3.0 | 3.0 | 3.0 |
| DEG | 15.0 | 25.0 | 25.0 | 25.0 |
| Block Copolymer | - | 1.0 | 1.0 | 1.0 |
| Deionized Water | 82.5 | 71.0 | 71.0 | 71.0 |
| Viscosity (mP·s) | 1.8 | 2.7 | 2.3 | 2.5 |
| Surface Tension (mN/m) | 47 | 36 | 36 | 36 |
| Absorption Coefficient: Ka ($ml/m^2 \cdot ms^{-1/2}$) | 0.2 | 3.0 | 2.8 | 2.8 |
| Wetting Time: Tw (ms) | 140 | 10 | 8 | 8 |
| Td (s) | 3.26 | - | - | - |

Block Copolymer: Copolymer of propylene oxide and ethylene oxide; and average molecular weight of the copolymer is 1700 and the content of ethylene oxide in the copolymer is 30%.

Printing order: Black - Cyan - Magenta - Yellow
Time difference: Approximately 3.5 sec. between black and cyan

FIG. 13

COMPOSITION, PHYSICAL PROPERTIES, AND CHARACTERISTICS OF INKS OF EXAMPLE 5
(FX-L paper manufactured by Fuji Xerox Co., Ltd.) Vr = 7.5 (25°C)

| | BLACK | CYAN | MAGENTA | YELLOW |
|---|---|---|---|---|
| Ink Compositions dye | 2.5 | 3.0 | 3.0 | 3.0 |
| DEG | 10.0 | 25.0 | 25.0 | 25.0 |
| Block Copolymer | - | 3.0 | 3.0 | 3.0 |
| Deionized Water | 87.5 | 69.0 | 69.0 | 69.0 |
| Viscosity (mP·s) | 1.6 | 4.0 | 3.8 | 4.0 |
| Surface Tension (mN/m) | 62 | 34 | 32 | 34 |
| Absorption Coefficient: Ka ($ml/m^2 \cdot ms^{-1/2}$) | 0.4 | 2.5 | 2.7 | 2.6 |
| Wetting Time: Tw (ms) | 120 | 8 | 10 | 6 |
| Td (s) | 1.30 | - | - | - |

Block Copolymer: Copolymer of propylene oxide and ethylene oxide; and average molecular weight of the copolymer is 1700 and the content of ethylene oxide in the copolymer is 30%.

Printing order: Black - Cyan - Magenta - Yellow
Time difference: Approximately 1.5 sec. between black and cyan

FIG. 14

COMPOSITION, PHYSICAL PROPERTIES, AND CHARACTERISTICS OF INKS OF EXAMPLE 6
(FX-L paper manufactured by Fuji Xerox Co., Ltd.) Vr = 7.5 (25°C)

| | BLACK | CYAN | MAGENTA | YELLOW |
|---|---|---|---|---|
| Ink Compositions dye | 2.5 | 3.0 | 3.0 | 3.0 |
| DEG | 10.0 | 25.0 | 25.0 | 25.0 |
| Block Copolymer | - | 3.0 | 3.0 | 3.0 |
| Deionized Water | 87.5 | 69.0 | 69.0 | 69.0 |
| Viscosity (mP·s) | 1.6 | 4.0 | 3.8 | 4.0 |
| Surface Tension (mN/m) | 62 | 34 | 32 | 34 |
| Absorption Coefficient: Ka ($ml/m^2 \cdot ms^{-1/2}$) | 0.5 | 2.8 | 3.0 | 3.0 |
| Wetting Time: Tw (ms) | 120 | 8 | 10 | 6 |
| Td (s) | 3.26 | - | - | - |

Block Copolymer: Copolymer of propylene oxide and ethylene oxide; and average molecular weight of the copolymer is 1700 and the content of ethylene oxide in the copolymer is 30%.

Printing order: Black - Cyan - Magenta - Yellow
Time difference: Approximately 1.0 sec. between black and cyan

FIG. 15

COMPOSITION, PHYSICAL PROPERTIES, AND CHARACTERISTICS OF INKS OF COMPARISON 5
(FX-L paper manufactured by Fuji Xerox Co., Ltd.) Vr = 7.5 (25°C)

| | BLACK | CYAN | MAGENTA | YELLOW |
|---|---|---|---|---|
| Ink Compositions dye | 2.5 | 3.0 | 3.0 | 3.0 |
| DEG | 15.0 | 15.0 | 15.0 | 15.0 |
| Deionized Water | 82.5 | 82.0 | 82.0 | 82.0 |
| Viscosity (mP·s) | 1.8 | 1.7 | 1.8 | 1.9 |
| Surface Tension (mN/m) | 61 | 60 | 60 | 59 |
| Absorption Coefficient: Ka ($ml/m^2 \cdot ms^{-1/2}$) | 0.2 | 0.2 | 0.3 | 0.2 |
| Wetting Time: Tw (ms) | 140 | 130 | 110 | 120 |
| Td (s) | 3.26 | 3.55 | 3.31 | 3.26 |

Printing order: Black - Cyan - Magenta - Yellow
Time difference: Approximately 2.0 sec. between black and cyan

FIG. 16

COMPOSITION, PHYSICAL PROPERTIES, AND CHARACTERISTICS OF INKS OF COMPARISON 6
(FX-L paper manufactured by Fuji Xerox Co., Ltd.) Vr = 8.5 (50°C)

| | BLACK | CYAN | MAGENTA | YELLOW |
|---|---|---|---|---|
| Ink Compositions dye | 3.0 | 3.0 | 3.0 | 3.0 |
| DEG | 25.0 | 25.0 | 25.0 | 25.0 |
| Block Copolymer | 1.0 | 1.0 | 1.0 | 1.0 |
| Deionized Water | 71.0 | 71.0 | 71.0 | 71.0 |
| Viscosity (mP·s) | 2.6 | 2.7 | 2.3 | 2.5 |
| Surface Tension (mN/m) | 35 | 36 | 36 | 36 |
| Absorption Coefficient: Ka ($ml/m^2 \cdot ms^{-1/2}$) | 3.1 | 3.0 | 2.8 | 2.8 |
| Wetting Time: Tw (ms) | 12 | 10 | 8 | 8 |
| Td (s) | - | - | - | - |

Block Copolymer: Copolymer of propylene oxide and ethylene oxide; and average molecular weight of the copolymer is 1700 and the content of ethylene oxide in the copolymer is 30%.

Printing order: Black - Cyan - Magenta - Yellow
Time difference: No time difference is present between black and cyan

FIG. 17

EVALUATION OF PRINT RESULTS OF EXAMPLES AND COMPARISONS

| | EXAMPLE 4 | EXAMPLE 5 | EXAMPLE 6 | COMP. 4 | COMP. 5 | COMP. 6 |
|---|---|---|---|---|---|---|
| CHARACTER QUALITY | EXCELLENT | GOOD | EXCELLENT | GOOD | GOOD | MODERATE |
| LINE QUALITY | EXCELLENT | GOOD | EXCELLENT | GOOD | GOOD | POOR |
| DENSITY | GOOD | GOOD | GOOD | GOOD | GOOD | MODERATE |
| INTERCOLOR SPREAD | GOOD | GOOD | GOOD | POOR | POOR | GOOD |

INK JET RECORDING METHOD AND APPARATUS

BACKGROUND OF THE INVENTION

1. Field of the Invention

The present invention relates to an ink jet recording method and apparatus. More specifically, the present invention relates to an ink jet recording method which can record a high quality image on a normal paper such as Xerography paper which is usually used in a Xerography copying machine or the like and apparatus therefor.

2. Discussion of the Prior Art

In a conventional ink jet recording method, a jetting energy generator, such as a piezoelectric element or an electrothermic transdoting element, is used as a jet drive source. As shown in FIG. 18, ink droplets are jetted forth through nozzles to a recording medium 100, such as recording paper, film, or cloth by the jet drive source so that an image is recorded on the recording medium 100. This ink jet recording method has many excellent advantageous features which include low noise and further, no requirement of any special fixing process capable of the recording of full color images as well as merely black and white images.

A recording paper for the ink jet recording is frequently used in the full color image recording by the above ink jet recording method. The recording paper has a coat layer which is formed by applying hydrophilic binder containing fine particles of $SiO_2$, CaO, or the like, dispersed on a original recording paper so as to improve the absorption and fixing of ink to the recording medium to obtain a high quality image. However, the use of this special paper increase the cost to produce one sheet of print, viz., the running cost.

If papers of less ink absorption, such as Xerography papers or quality papers, usually used for Xerography copying machines, are used for the full color image recording by the ink jet recording method, several problems arise. A full color image, which is recorded on a paper of less ink absorption by using ink of the slow-dry type which can depict characters and line images of relatively high image quality, is poor in quality. As shown in FIGS. 19(*a*) and (*b*), ink droplets 101 including four color of black(Bk), cyan(C), magenta(M), and yellow(Y) are not dried quickly enough to prevent flowing of the droplets so that adjacent ink droplets are connected with each other. Accordingly, spreading of ink, called color bleeding 102, takes place among adjacent ink droplets of different colors, thereby inevitably bringing about a color mixture to deteriorate the image quality.

In a case where a paper of less ink absorption, such as Xerography paper or quality paper, and ink of relatively quick dry/penetration type are used for the full color image recording, the ink spread phenomenon among different color ink droplets does not take place. However, the following problems arises anew. As shown in FIG. 20, since ink droplets 101 deeply penetrate into the recording medium 100, little coloring materials are left on the surface of the paper. Accordingly, the print area by the ink droplets 101 is low in density and the range of the color reproduction is narrow. Further, the ink is dried in a state that it is horizontally spread in the surface of the recording medium. Therefore, the reproduced characters/lines are fatty, and deterioration of the image quality owing to the feathering is great.

Thus, in the conventional ink jet recording method, it is very difficult to improve both the full color image and the black/white image in image quality when the paper is of less ink absorption than the special paper exclusively for the ink jet recording is used. Accordingly, in the printing by the conventional ink jet recording method, those papers specially used for the ink jet recording must be used for the recording medium. Therefore, the cost to produce one sheet of print, viz., the running cost, is inevitably high. The high running cost hinders the prevalence of the ink jet recording devices.

Many practical techniques to solve the problems have been proposed. Some of these techniques will be referred to below. The ink jet recording device disclosed in Unexamined Japanese Patent Publication No. Hei. 4-355157 discloses a color ink jet recording device for recording a color image using inks of different colors, which is constructed such that the inks of those colors are prepared in their compositions so as to make the panetration of at least one ink ingo a recording medium different from that of the other inks.

The ink jet recording device disclosed in unexamined Japanese Patent Publication No. Hei. 4-364961 discloses a color ink jet recording device for recording a color image using inks of different colors by means of a plural number of recording means, which is constructed such that the inks of those colors are prepared in their compositions so as to make the fixing performance for at least one ink on a recording medium different from that for the other inks. Further, the ink recording device is operable such that a fixing rate of ink first jetted to the recording medium is higher than that of ink subsequently jet.

The conventional ink jet recording devices have several problems to be solved. The penetration difference of the ink to such an extent as in the ink jet recording device disclosed in Unexamined Japanese Patent Publication No. Hei. 4-355157 fails to satisfactorily achieve both the improvements of the image quality; elimination of the color bleeding among the image areas of different colors and realizing of a sharp image.

For the ink jet recording device disclosed in Unexamined Japanese Patent Publication No. Hei. 4-364961, constructed such that the inks of different colors are prepared in their compositions so as to make the fixing performance at least one ink on a recording medium different from the penetration of another ink, and that a fixing rate of ink first jetted to a recording medium is higher than that of ink subsequently jet, the following disadvantageous fact was empirically confirmed by the inventors of the present invention. A penetration rate of the later jetted ink C of low fixing rate when it is jetted to an already recorded area A on the recording medium is greatly different from its penetration race when it is jetted to a non-recorded area B thereof. With this great difference of the penetration rates, the ink C is irregularly pulled to the already recorded area, causing the color bleeding as shown in FIGS. 21(*c*). For example, an intercolor spread occurs as shown in FIG. 21(*a*). In addition, the circumference of characters are spread, as shown in FIG. 21(*b*).

SUMMARY OF THE INVENTION

The present invention has an object to provide an ink jet recording method which can record color images with no color ink spread and sharp characters/line images on a recording medium of low ink absorption, effectively and without any loss of recording speed.

Another object of the present invention is to provide an ink jet recording device which can record color images with no color ink spread and sharp characters/line images on a recording medium of low ink absorption, effectively and without any loss of recording speed.

To achieve the first object, there is provided an ink jet recording method for recording images on a recording medium by a plural number of recording heads for jetting forth droplets of water-soluble dyes contained aqueous inks of different colors, the recording method ie improved in that after a first ink of low penetration rate is jetted for printing to the recording medium, a second ink of high penetration rate is jetted for printing to the recording medium, the absorption coefficient (Ka) of the first ink is 0.5 $ml/m^2 \cdot ms^{1/2}$ or smaller and the wetting time (Tw) thereof is 50 to 200 ms, and the absorption coefficient (Ka) of the second ink is 1.0 $ml/m^2 \cdot ms^{1/2}$ or larger and the wetting tame (Tw) is 20 msec or shorter.

To achieve the second object, there is provided an ink jet recording device for recording images on a recording medium by a plural number of recording heads for jetting forth droplets of water-soluble dyes contained aqueous inks of different colors, the recording device is improved in that after a first ink of low penetration rate is jetted for printing to the recording medium, a second ink of high penetration rate is jetted for printing to the recording medium, the absorption coefficient (Ka) of the first ink is 0.5 $ml/m^2 \cdot ms^{1/2}$ or smaller and the wetting time (Tw) thereof is 50 to 200 ms, and the absorption coefficient (Ka) of the second ink is 1.0 $ml/m^2 \cdot ms^{1/2}$ or larger and the wetting time (Tw) is 20 msec or shorter.

Thus, in the ink jet recording method and device of the invention, after a first ink of low penetration rate is jetted for printing to the recording medium, a second ink of high penetration rate is jetted for printing to the recording medium. Because of this, color images with no color ink spread and sharp characters/line images can be printed on a recording medium of low ink absorption.

An ink jet recording method and apparatus according to an embodiment of the present invention records images on a recording medium by a plural number of recording heads for different colors. Aqueous inks of different colors, which are jetted forth in the form of ink droplets from the recording heads for printing, contain water-soluble dyes dissolved thereinto. In the ink jet recording method, after a first ink of low penetration rate is jetted for printing to the recording medium, a second ink of high penetration rate is jetted for printing to the recording medium. The absorption coefficient (Ka) of the first ink is 0.5 $ml/m^2 \cdot ms^{1/2}$ or smaller and the wetting tame (Tw) thereof is 50 to 200 ms. The absorption coefficient (Ka) of the second ink is 1.0 $ml/m^2 \cdot ms^{1/2}$ or larger and the wetting time (Tw) is 20 msec or shorter.

More specifically, in the ink jet recording method, the first ink may be jetted for printing to the recording medium, and the second ink is jetted for printing to the recording medium after at least a time Td given by the following formula elapses from the jetting of the first ink, $$Td=\{(Vd\times N+Vr-Vb)/Ka\}^2\times 10^{-3}(\text{sec})$$

where

Vd (ml): drop volume

N: number of dots per unit area ($m^2$)

Vr ($ml/m^3$): coarse index of the recording medium measured by the Bristow tester Vb ($ml/m^3$): value of the ink absorption rectilinear curve inclined at Ka, when T (ink contact time)=0.

In the ink jet recording method, the recording medium may be heated.

An ink jet recording device according to another embodiment of the present invention records images on a recording medium by a plural number of recording heads for different colors. Aqueous inks of different colors, which are jetted forth in the form of ink droplets from the recording heads for printing, contain water-soluble dyes dissolved thereinto. In the ink jet recording device, after a first ink of low penetration rate is jetted for printing to the recording medium, a second ink of high penetration rate is jetted for printing to the recording medium. The absorption coefficient (Ka) of the first ink is 0.5 $ml/m^2 \cdot ms^{1/2}$ or smaller and the wetting time (Tw) thereof is 50 to 200 ms. The absorption coefficient (Ka) of the second ink is 1.0 $ml/m^2 \cdot ms^{1/2}$ or larger and the wetting time (Tw) is 20 msec or shorter.

BRIEF DESCRIPTION OF THE DRAWINGS

Other objects, features, and advantages of the present invention will be apparent from the following detailed description in connection with the accompanying drawings, in which:

FIG. 6 is a table showing compositions, physical properties, and characteristics of inks used in EXAMPLE 1;

FIG. 7 is a table showing compositions, physical properties, and characteristics of inks used in COMPARISON 1;

FIG. 8 is a table showing compositions, physical properties, and characteristics of inks used in COMPARISON 2;

FIG. 9 is a table showing compositions, physical properties, and characteristics of inks used in EXAMPLE 2;

FIG. 10 is a table showing compositions, physical properties, and characteristics of inks used in EXAMPLE 3;

FIG. 11 is a table showing the evaluation of print results of EXAMPLES and COMPARISONS;

FIG. 12 is a table showing compositions, physical properties, and characteristics of inks used in EXAMPLE 4;

FIG. 13 is a table showing compositions, physical properties, and characteristics of inks used in EXAMPLE 5;

FIG. 14 is a table showing compositions, physical properties, and characteristics of inks used in EXAMPLE 6;

FIG. 15 is a table showing compositions, physical properties, and characteristics of inks used in COMPARISON 5;

FIG. 16 is a table showing compositions, physical properties, and characteristics of inks used in COMPARISON 6;

FIG. 17 is a table showing the evaluation of print results of EXAMPLES and COMPARISONS;

DETAILED DESCRIPTION OF THE PREFERRED EMBODIMENTS

The detailed description of the preferred embodiments of the present invention will be described accompanying with the drawings as follows.

In order to record character images and color images on normal papers, such as Xerography papers in an excellent image quality using aqueous inks containing water-soluble dyes by the ink jet recording device, the ink spread in the recording paper is problematic. To evaluate a state of spread of ink in the recording paper, two factors may be used, ink absorption coefficient and wetting time.

Figure 22:
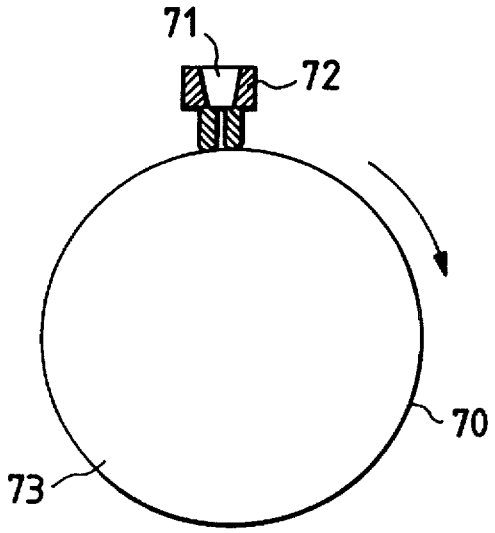
FIG. 22 is a diagram schematically showing a test device for testing a state of penetration of ink into a recording medium.
Figure 23:
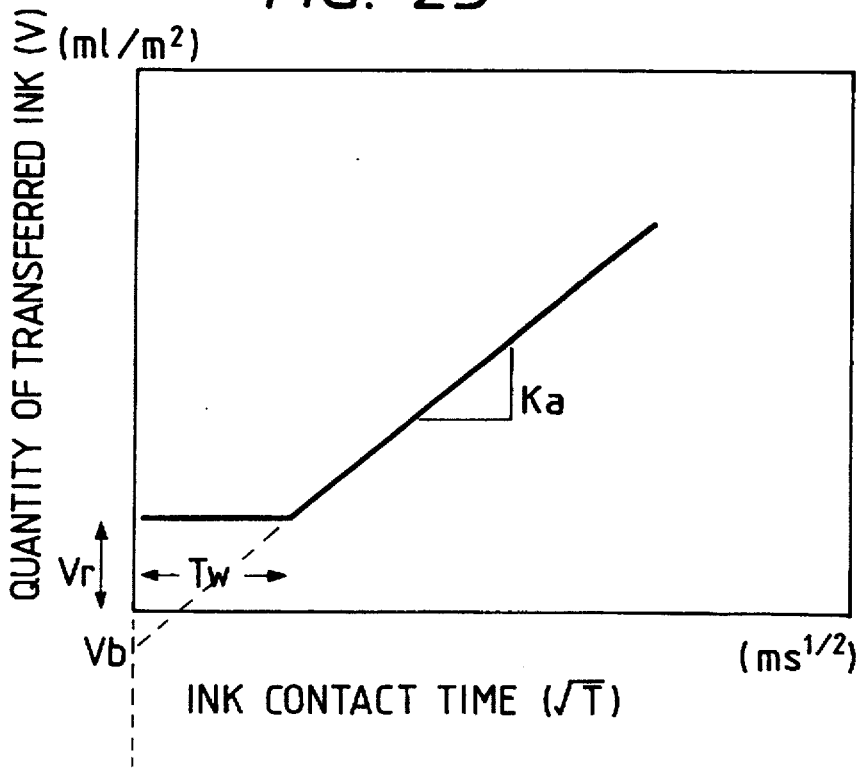
FIG. 23 is a graph showing a variation of the quantity of ink transferred to a recording medium with respect to ink contact time.

The ink absorption coefficient (Ka) and the wetting time (Tw) are measured by the Bristol Tester according to Japan Tappi Paper Pulp Test Method No. 51–87. For the measurement, as roughly illustrated in FIG. 22, a predetermined quantity of ink 71 is put into a head box 72. The ink 71 is transferred to a paper 70 attached to the outer surface of a rotary cylinder 73. Thus, a quantity of the ink 71 transferred to the paper 70 is measured. The quantities of the transferred ink 71 can be measured in the range from 0.004 to 2 seconds by varying revolutions of the cylinder 73. An example of a relationship between the quantity of the transferred ink and the contact time is illustrated in FIG. 23. In the graph, the scale of the ink contact time is expressed in the square root of time (T). An inclination of a rectilinear curve of the ink absorption indicates absorption coefficient (Ka). The quantity of the transferred ink when the contact time is 0 sec. is called coarse coefficient (Vr) which represents a quantity of ink filling the irregular surface of the paper. In addition, a value of Vb is a crossing point of V axis and an extrapolated ink absorption rectilinear curve inclined at Ka. A period (Tw) of time where no ink is absorbed exists in the initial stage of the contact of ink with the paper. It is called an ink wetting time. This time is consumed till the paper is wet with the ink. The absorption coefficient is equal to the coefficient when an absorption time (t) is treated as a parameter in Lucas-Washborn formula given below.

$$V=(\epsilon/\tau)\{(\gamma\cos\Theta rt/2\eta\}^{1/2}$$

where

V: quantity of ink absorption per unit time

ε: percentage of voids of paper

τ: bending rate of a capillary tube on the paper surface r: diameter of the capillary tube on the paper surface cos θ: contact angle of paper and ink γ: surface tension of ink t: absorption time of ink η: viscosity of ink The absorption coefficient (Ka) of ink is determined by a surface state of paper, physical properties of ink, and wetting property of ink and paper.

It is desirable that the paper satisfies the following conditions ash content; 2.0 to 20.0%, thickness; 75 to 120 μm, weight; 50 to 100 g/m$^2$, the stoeckigt size degree; 0 to 60 sec.; degree of smoothness; 10 to 150 sec. The papers satisfying these conditions may be normal papers for copying machines, such as Sanyo Kokusaku L papers, Sanyo Kokusaku P papers, and Xerox 4024 papers. The contact angle θ of the ink and the paper, which affects an influence on the wetting properly of the ink, desirably satifies 90°>θ>60°.

Specific embodiments of the present invention will be described with reference to the accompanying drawings.

Figure 1:
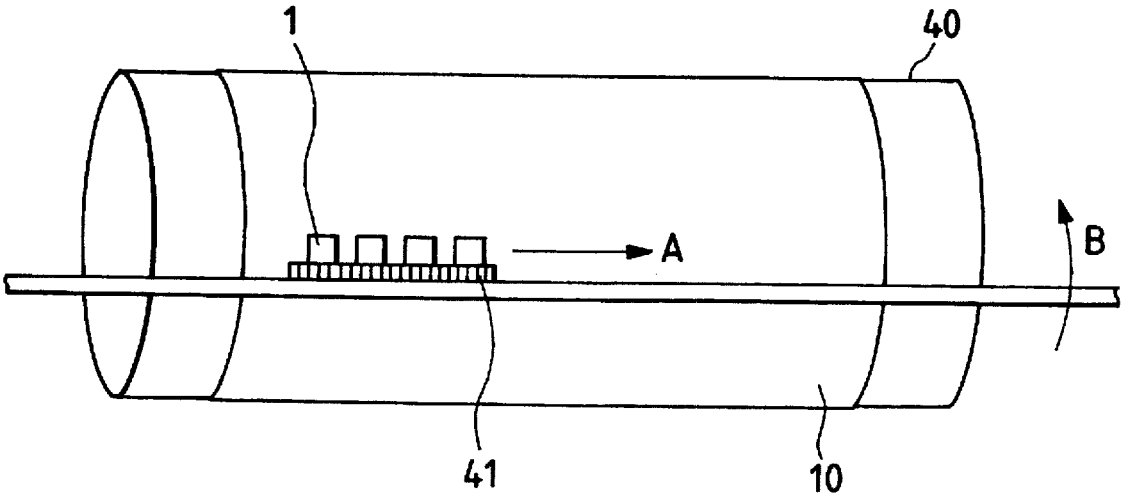
FIG. 1 is a schematic diagram showing an ink jet recording device incorporating an ink jet recording method according to the present invention.

FIG. 1 shows an embodiment of an ink jet recording device according to the present invention.

Figure 2:
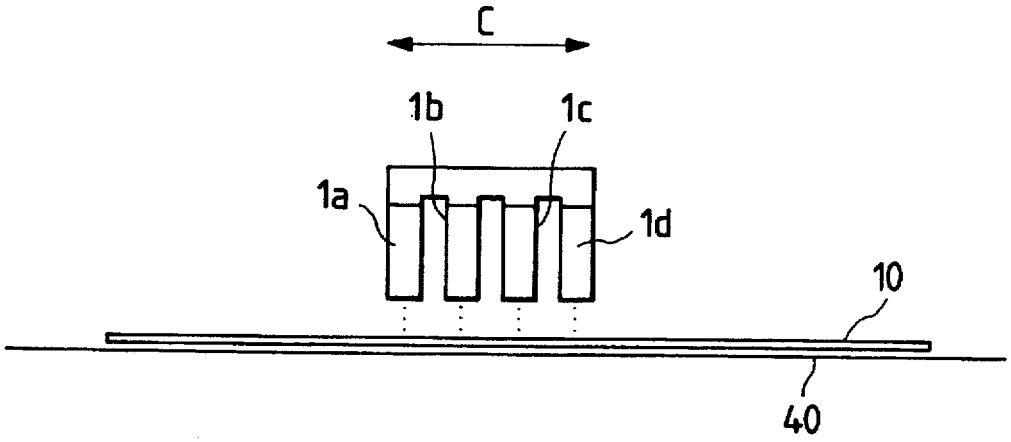
FIG. 2 is a front view showing a recording head used in the ink jet recording device of FIG. 1.

In the figure, reference numeral 40 designates a rotary drum with a recording paper 10 wound thereon. The rotary drum 40 is arranged so as to be rotated in the direction of an arrow B by a drive device, not shown, in a state that the recording paper 10 is wound around the rotary drum 40. In the vicinity of the rotary drum 40, a recording head 1 is disposed facing the surface of the recording paper 10. The recording head 1 is moved in the axial direction of the rotary drum 40 by a carriage 41. The recording head 1, which is moved for scan in the directions of arrows C, is provided with four recording portions 1*a*, 1*b*, 1*c*, and 1*d* for four colors, black, cyan, magenta, and yellow, as shown in FIG. 2. These recording portions 1*a*, 1*b*, 1*c*, and 1*d* jet forth, through their nozzles, black, cyan, magenta, and yellow inks toward the recording paper 10 as a recording medium in accordance with image data, thereby printing an image in an area of a predetermined print width on the recording paper 10. Each of the recording portions 1*a*, 1*b*, 1*c*, and 1*d* of the recording head 1 are provided with 128 nozzles arrayed in the carriage moving direction of an arrow A, so as to print an image at a recording density of 400 dpi. These recording portions are capable of printing an image of approximately 8.1 mm wide for each turn of the rotary drum 40. Further, the recording portions 1*a*, 1*b*, 1*c*, and 1*d* of the recording head 1 are arranged so as to jet forth, for printing, the inks to a position on the recording paper 10 at intervals of about 5 seconds. These inks are aqueous inks into which water-soluble dyes of black, cyan, magenta, and yellow are dissolved.

In the present embodiment, after a black ink of low penetration rate is jetted forth, for printing, to the recording paper, color inks of high penetration rate are jetted forth to the recording paper.

For the ink used for the black ink of low penetration rate, the absorption coefficient (Ka) of the ink to the recording paper is 0.5 ml/m$^2$·ms$^{1/2}$ or smaller, and the wetting time (Tw) thereof is 50 to 200 ms. For the ink used for the color ink of high penetration rate, the absorption coefficient (Ka) of the ink to the recording paper is 1.0 ml/m$^2$·ms$^{1/2}$ and the wetting time (Tw) thereof is 20 msec or shorter.

In the ink jet recording device of the present embodiment, an image is first printed using the black ink of low penetration rate, and then is printed using the color inks of high drying rate in the order of the cyan, magenta and yellow inks.

An ink jet recording device constructed on the basis of this technical idea will be described with reference to FIG. 3.

Figure 3:
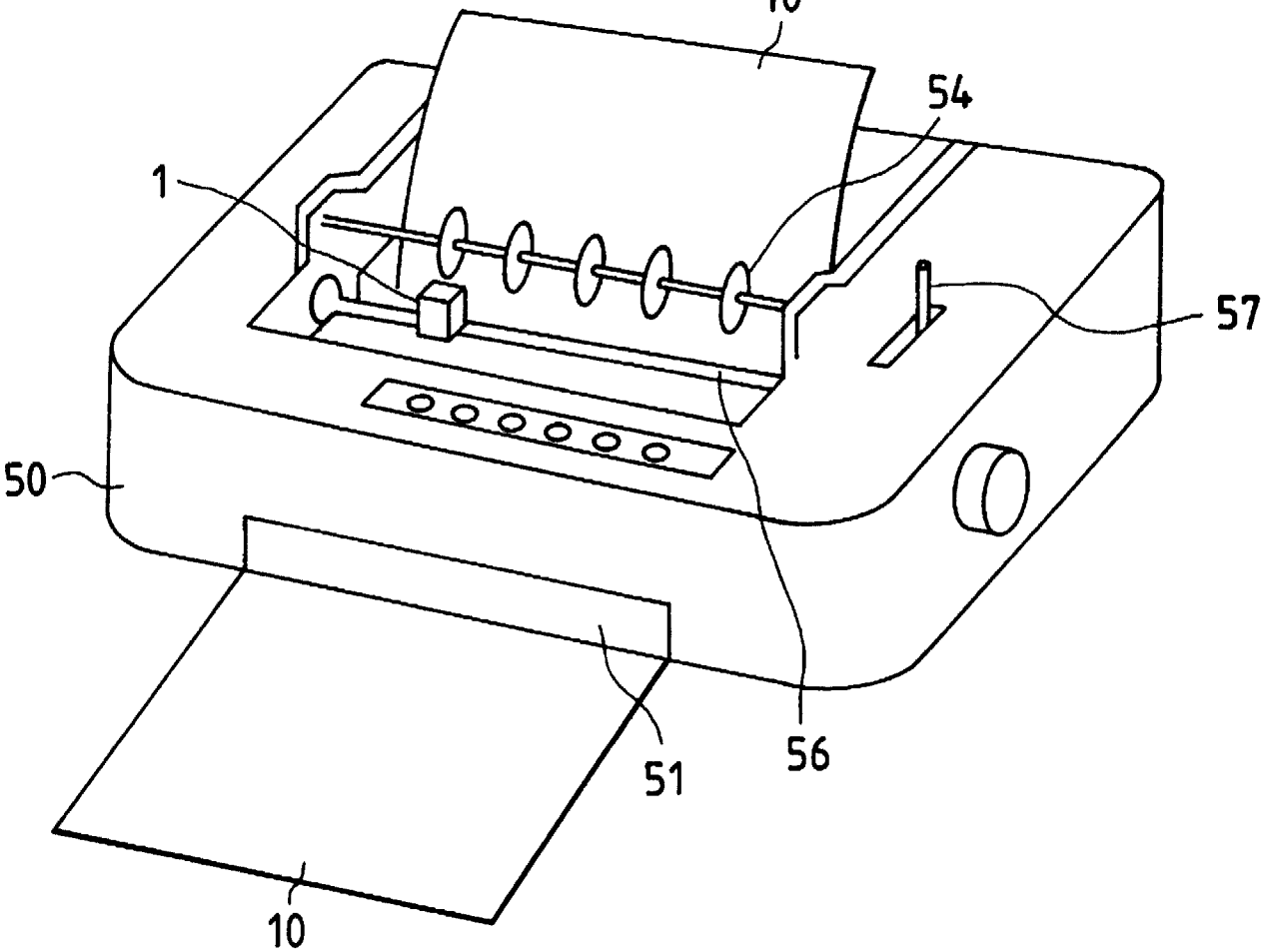
FIG. 3 is a perspective view showing an ink jet recording device incorporating another ink jet recording method according to the present invention.

In the ink jet recording device shown in FIG. 3, the color inks are always jotted forth in the order of black, cyan, magenta, and yellow inks.

In the ink jet recording device, the ink of slow penetration is first used for printing. After a preset time elapses from the Jesting of that ink, the ink of high penetration is used for printing.

Figure 4:
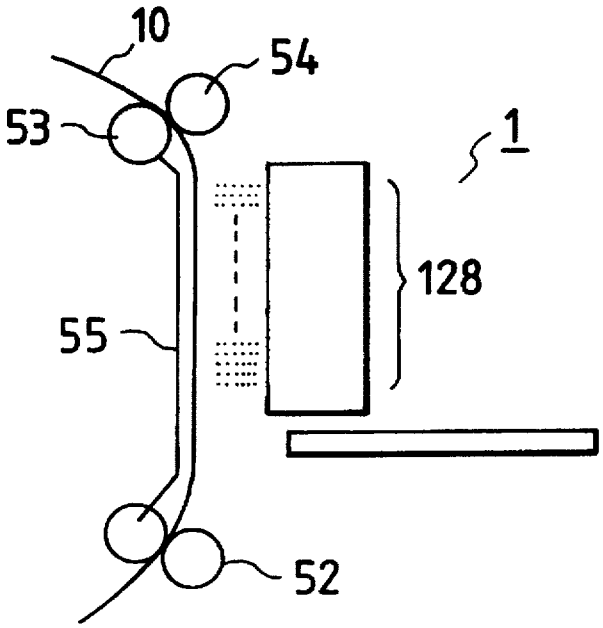
FIG. 4 is a plan view showing a recording section of the ink jet recording device.
Figure 5:
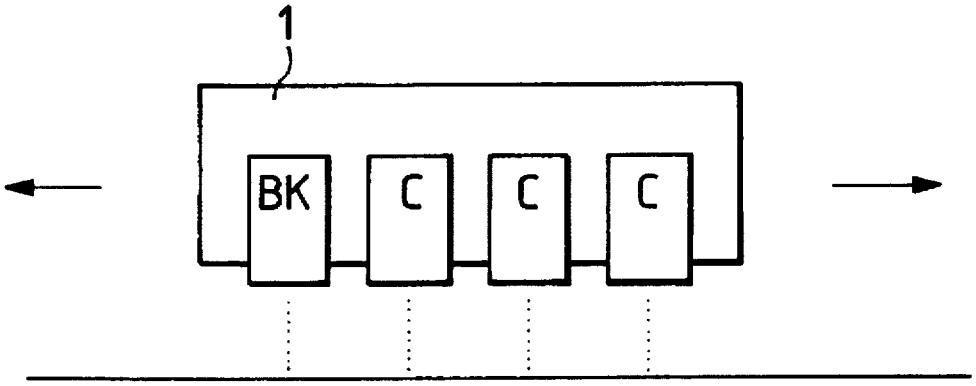
FIG. 5 is a front view showing a recording head used in the ink jet recording device of FIG. 3.
Figure 18:
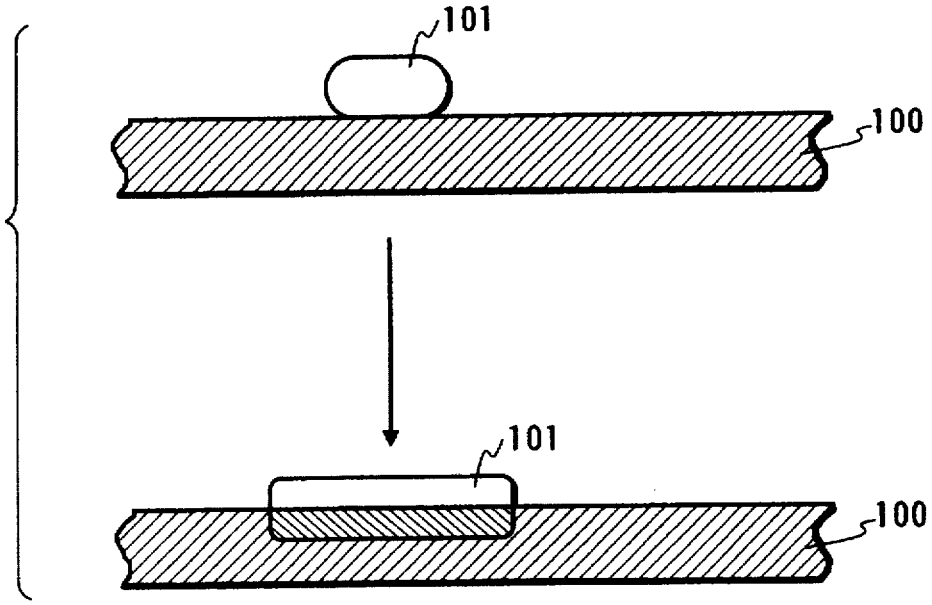
FIG. 18 is a diagram showing a model of penetration of ink into a recording medium.
Figure 19A:
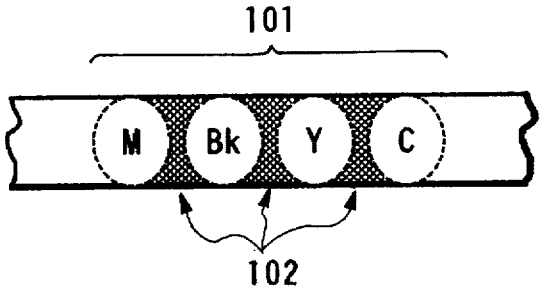
FIG. 19(a) PRIOR ART
FIGS. 19(*a*) and (*b*) are diagrams showing a model of penetration of slow-dry type color ink into a paper of less ink absorption.
Figure 19B:
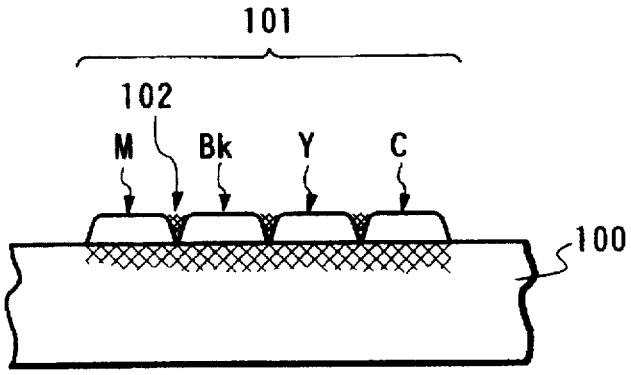
FIG. 19(b) PRIOR ART
Figure 20A:
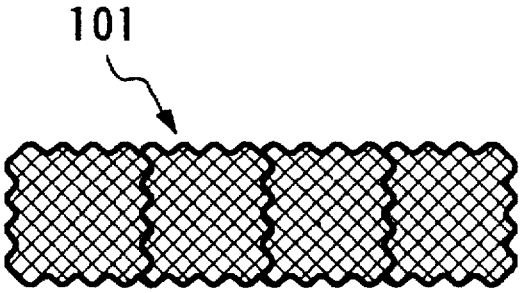
FIG. 20(a) PRIOR ART
FIGS. 20(*a*) and (*b*) are diagrams showing a model of penetration of quick-dry/penetration type color ink into a paper of less ink absorption.
Figure 20B:
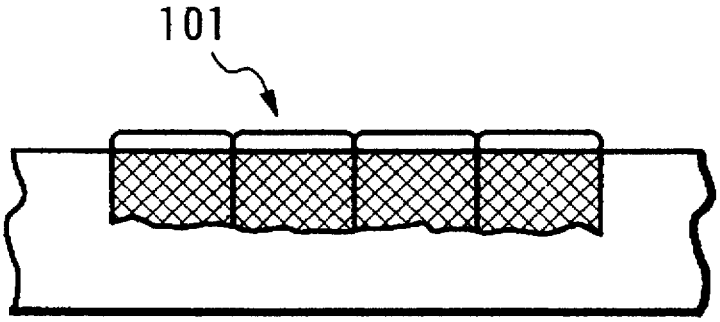
FIG. 20(b) PRIOR ART
Figure 21A:
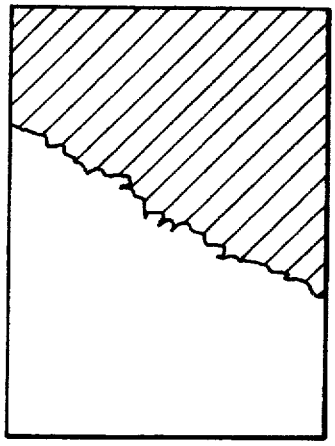
FIG. 21(a) PRIOR ART
FIGS. 21(*a*) to (*c*) are diagrams showing characters printed on a recording medium, the characters suffering from intercolor feathering.
Figure 21B:
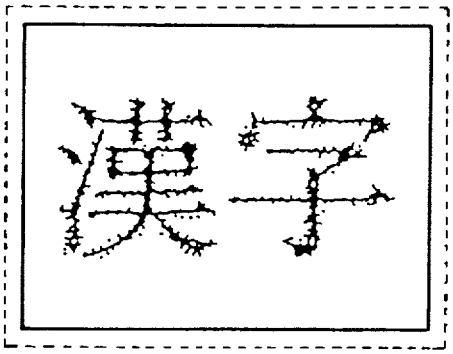
FIG. 21(b) PRIOR ART
Figure 21C:
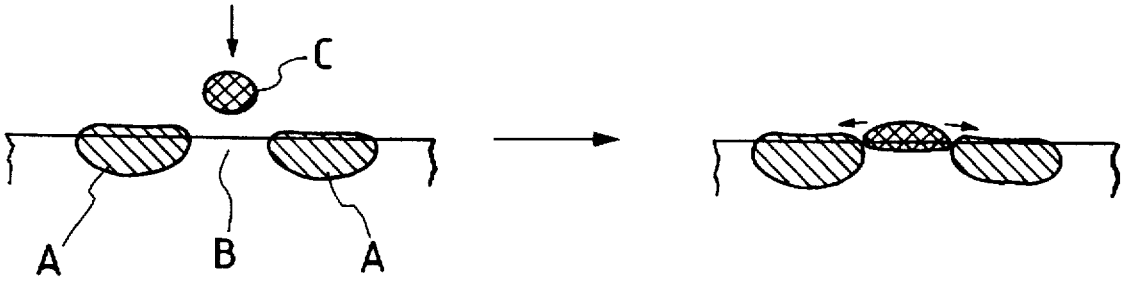
FIG. 21(c) PRIOR ART

The recording of a color image by the second ink jet recording device will be described. To start with, a recording paper 10, as shown in FIG. 3, is inserted into a main body 50 of the recording device through a paper feed port 51 to set on a platen 55 as shown in FIG. 4. The printing operation starts in a state that the black recording portion of the recording head first jets forth the black ink while the recording head 1 is being moved along a carriage rail 56 to the right in FIG. 5.

Next, the recording head 1 is moved to a record start position or the recording head 1 is left positioned at the right end. In this state, the recording head 1 is moved from the record start position to the right or from the right end to the left after a preset time elapses from the print of the black image. During this movement of the recording head 1, an image of cyan is printed on the already printed black image with the recording portion 1*b* of the recording head 1.

Subsequently, the recording head 1 is moved to print images of magenta and yellow on the previously printed image in successive manner. In this way, the printing operation progresses. After the images of one line are all printed, the recording paper 10 is fed forward by one line, and the printing operation for the next line starts.

EXAMPLE 1

Experiment as given below is conducted in order to check whether or not the ink jet recording devices thus constructed and operated can record color images of no color spread and sharp character/line images on a recording medium of less ink absorption, such as Xerography paper usually used for xerography copying machines and qualify paper, using the aqueous ink containing water-soluble dyes dissolved thereinto.

Black characters and four color images of black, cyan, magenta, and yellow were printed by using the ink jet recording device with the recording head 1 of 400 dpi in print density as mentioned above. After 5 seconds elapses from the print by the black ink, the print by the color inks was carried out. Ink absorption characteristic and physical properties of inks used in EXAMPLE 1 are shown in FIG. 6. The compositions and the characteristics of the inks were measured by using FX-L paper (manufactured by Fuji Xerox Co., Ltd.).

COMPARISON 1

Inks used in COMPARISON 1 had compositions and characteristics as shown in FIG. 7. The inks of black, cyan, magenta, and yellow were poor in absorption by the paper and slow in penetration into the paper. The same type of papers as used in EXAMPLE 1 were used also in COMPARISON 1.

COMPARISON 2

Inks used in COMPARISON 2 had compositions and characteristics as shown in FIG. 8. The inks were good in absorption by the paper and high in penetration into the paper. The same type of papers as used in COMPARISON 2 were used also in EXAMPLE 1.

COMPARISON 3

The same type of papers as used in EXAMPLE 1 were used also in COMPARISON 3. The order of printing was reverse to that in EXAMPLE 1. Namely, an image by black ink was printed finally.

EXAMPLEs 2 and 3

Inks used in EXAMPLEs 2 and 3 had compositions, physical properties, and absorption characteristics shown in FIGS. 9 and 10, respectively.

The results of the prints in those EXAMPLEs and COMPARISONS are shown in FIG. 11.

Black ink is used for the ink of slow penetration rate, and Color inks of cyan, magenta, and yellow, for example, are used for the inks of high penetration rate. For the ink of slow penetration, the absorption coefficient (Ka) of the ink to the recording paper may be 0.5 $ml/m^2 \cdot ms^{1/2}$ or smaller and the wetting time (Tw) thereof may be 50 to 200 ms. For the ink of quick penetration, the absorption coefficient (Ks) of the ink to the recording paper may be 10 $ml/m^2 \cdot ms^{1/2}$ and the wetting time (Tw) thereof may be 20 msec or shorter.

The time difference between the end of the printing by the ink of slow penetration and the start of the printing by the ink of quick penetration is set between 0.5 to 35 sec., for example.

In this example, the black ink of slow drying is first used for printing. After a preset time Td elapses from the end of the printing by the black ink, the color inks of cyan, magenta, and yellow are used in this order for printing their color images.

The preset time Td is given by the following formula elapses from the printing of the black ink on said recording medium;

$$Td=\{(Vd\times N+Vr-Vb)/Ka\}^2\times 10^{-3}\ \text{(sec)},$$

where

Vd (ml): black ink drop volume;

N: t number of dots per unit area ($m^2$);

Vr ($ml/m^3$): coarse index of the recording medium measured by the Bristow tester;

Vb ($ml/m^3$): value of the black ink absorption rectilinear curve inclined at Ka, when T (ink contact time)=0; and Ka: the absorption coefficient of the black ink.

EXAMPLE 4

Experiment as given below is conducted in order to establish the conditions which allows the ink jet recording devices thus constructed and operated to record color images of no color spread and sharp character/line images on a recording medium of less ink absorption, such as Xerography paper usually used for Xerography copying machines and quality paper, using the aqueous ink containing water-soluble dyes dissolved thereinto.

Black characters and four color images of black, cyan, magenta, and yellow were printed by using the ink jet recording device with the recording head 1 of 400 dpi in print density as mentioned above. Ink absorption characteristic and physical properties of inks used in EXAMPLE 4 are shown in FIG. 12. The compositions and the characteristics of the inks were measured by using FX-L paper (manufactured by Fuji Xerox corporation). The volume of an ink drop of the black ink was $40\times10^{-9}$ ml. The time difference Td when a solid pattern was printed was 3.26 sec. Accordingly, the time difference of approximately 3.5 sec., longer than Td=3.26 sec., was set between the printing by the black ink and the printing by the color inks. Temperature for the experiment was room temperature of 25° C.

The recording medium 10 was FX-L paper (manufactured by Fuji Xerox Co., Ltd.).

EXAMPLE 5

In EXAMPLE 5 as in EXAMPLE 4, inks used have compositions and characteristics as shown in FIG. 13. Paper used was FX-L paper (manufactured by Fuji Xerox Co., Ltd.). Only an image by the black ink was printed on the paper, and the paper was not fed forward so that images by the color inks of cyan, magenta, and yellow were printed on the same line, in this order. In this way, all of the image data were printed out. The volume of an ink drop of the black ink was $40\times10^{-9}$ ml. The time difference Td when a solid pattern was printed was 1.30 sec. Accordingly, the time difference of approximately 1.5 sec., longer than Td=1.30 sec., was set between the printing by the black ink and the printing by the color inks. The remaining conditions were the same as those in EXAMPLE 4.

EXAMPLE 6

In EXAMPLE 6, inks used have physical properties as shown in FIG. 14. Paper used was FX-L paper (manufactured by Fuji Xerox Co., Ltd.). Only an image by the black ink was printed on the paper and the paper was not fed forward so that images by the color inks of cyan, magenta, and yellow were printed on the same line, in this order. In this way, all of the image data were printed out. In EXAMPLE 6, in printing the images, the recording paper was heated at 50° C. by a heater, not shown, put on the rear side of the platen. In this case, it is preferable to be heated at 35° C. to 50° C. The volume of an ink drop of the black ink was $40\times10^{-9}$ ml. The time difference Td when a solid pattern was printed was 0.85 sec. Accordingly, the time difference of approximately 1 sec., longer than Td=0.85 sec., was set between the printing by the black ink and the printing by the color inks. The remaining conditions were the same as those in EXAMPLE 4.

COMPARISON 4

Inks used in COMPARISON 4 were the same as those used in EXAMPLE 4 shown in FIG. 13. In this comparison, an image by the black ink and images by the color inks were printed during one scan period. Therefore, the time difference between the printing of the image by the black ink and the printing of the images by the color inks was 0.12 sec.

COMPARISON 5

Inks of four colors used in COMPARISON 5 were all slow in penetration to the paper as shown in FIG. 15. The time difference of approximately 2 sec. was provided between the printing of the image by the black ink and the printing of the images by the color inks, as in EXAMPLE 4.

COMPARISON 6

Inks of four colors used in COMPARISON 6 were all high in penetration to the paper as shown in FIG. 16. No time difference was provided between the printing of the image by the black ink and the printing of the images by the color inks, as in COMPARISON 4.

The results of the prints in those EXAMPLEs 4, 5, and 6 and COMPARISONS 4, 5, and 6 are shown in FIG. 17.

As seen from the foregoing description, an ink jet recording device of the present invention uses aqueous inks of different colors, which contain water-soluble dyes dissolved thereinto, and is provided with a plural number of recording heads for jetting forth droplets of water-soluble dyes contained aqueous color inks. These different colors are, for example, black, cyan, magenta, and cyan. In the ink jet recording device, the absorption coefficient (Ka) of the black ink to the recording medium is 0.5 $ml/m^2\cdot ms^{1/2}$ or smaller and the wetting time (Tw) thereof is 50 to 200 ms, and the absorption coefficient (Ka) of each of other color inks is 1.0 $ml/m^2\cdot ms^{1/2}$ or larger and the wetting time (Tw) is 20 msec or shorter. The printing of images by these inks is carried out in a manner that an image is first printed using the ink of which the absorption coefficient (Ka) is 0.5 $ml/m^2\cdot ms^{1/2}$ or smaller and the wetting time.(Tw) thereof is 50 to 200 ms. After a minimum time Td elapses from the end of the first printing, images are printed using the inks of which the absorption coefficient (Ka) is 1.0 $ml/m^2\cdot ms^{1/2}$ or larger and the wetting time (Tw) is 20 msec or shorter. This minimum time delay Td is determined by ink absorption characteristics, ink drop volume, and the number of ink drops per unit area.

The ink jet recording device thus constructed can record color images with no color ink spread and sharp characters/line images on a normal paper as a recording medium of slow ink absorption.

While some specific embodiments of the present invention have been described, it should be understood that the invention may variously be changed, modified, and altered within the scope and true spirits of the appended claims.

What is claimed is:

1. An ink jet recording method using a plurality of recording heads each of which jets droplets of inks including a water-soluble dye of different color to record an image on a recording medium, comprising the steps of:

jetting a first ink from one of said plurality of recording heads to print on said recording medium, said first ink having an absorption coefficient (Ka) of 0.5 $ml/m^2\cdot ms^{1/2}$ or smaller and a wetting time (Tw) of 50 to 200 msec; and jetting a second ink from one of said plurality of recording heads to print on said recording medium, said second ink having an absorption coefficient (Ka) of 1.0 $ml/m^2\cdot ms^{1/2}$ or larger and a wetting time (Tw) of 20 msec or shorter;

wherein said step of jetting said second ink is performed so that said second ink is printed on said recording medium after at least a time Td, given by the following formula, elapses from the printing of said first ink on said recording medium;

$$Td=\{(Vd\times N+Vr-Vb)/Ka\}^2\times10^{-3}\ (\text{sec})$$

where

Vd (ml): first ink drop volume

N: number of dots per unit area ($m^2$);

Vr $ml/m^2$: coarse index of the recording medium;

Vb $ml/m^2$: value of first ink absorption rectilinear curve inclined at Ka, when T (ink contact time)=0; and Ka: the absorption coefficient of said first ink.

2. The ink jet recording method according to claim 1, further comprising the steps of:

jetting a third ink from one of said plurality of recording heads to print on said recording medium, said third ink having an absorption coefficient (Ka) of 1.0 $ml/m^2\cdot ms^{1/2}$ or larger and a wetting time (Tw) of 20 msec or shorter; and jetting a fourth ink from one of said plurality of recording heads to print on said recording medium, said fourth ink having an absorption coefficient (Ka) of 1.0 $ml/m^2\cdot ms^{1/2}$ or larger and a wetting time (Tw) of 20 msec or shorter.

3. An ink jet recording method according to claim 2, wherein said first ink is black, said second ink is cyan, said third ink is magenta and said fourth ink is yellow.

4. The ink jet recording method according to claim 1, wherein said step of jetting said second ink is performed so that said second ink is printed on said recording medium after at least a time Td, given by the following formula, elapses from the printing of said first ink on said recording medium;

$$td=\{(Vd\times N+Vr-Vb)/Ka\}^2\times10^{-3}(\text{sec}),$$

where

Vd (ml): first ink drop volume;

N: number of dots per unit area ($m^2$);

Vr $ml/m^2$: coarse index of the recording medium;

Vb $ml/m^2$: value of first ink absorption rectilinear curve inclined at Ka, when T (ink contact time)=0; and Ka: the absorption coefficient of said first ink.

5. The ink jet recording method according to claim 1, wherein said recording medium is heated.

6. The ink jet recording method according to claim 5, wherein said recording medium is heated at 35° C. to 50° C.

7. The ink jet recording method according to claim 1, wherein said recording medium is paper having an ash content of 2.0 to 20.0%, thickness of 75 to 120 μm, weight of 50 to 100 $g/m^2$, stoeckigt size degree of 0 to 60 sec., and degree of smoothness of 10 to 150 sec.

8. The ink jet recording method according to claim 1, wherein a contact angle of the ink and said recording medium is 60° to 90°.

9. An ink jet recording apparatus comprising:

a rotary drum for winding a recording medium thereon;

a main recording head disposed in the vicinity of said rotary drum to face a surface of said recording medium, which has a plurality of secondary recording heads each jetting droplets of ink comprising a water-soluble dye of a different color, said plurality of secondary recording heads including a first ink jetting portion for jetting a first ink to print on said recording medium, said first ink having an absorption coefficient (Ka) of 0.5 $ml/m^2\cdot ms^{1/2}$ or smaller and a wetting time (Tw) of 50 to 200 msec, and a second ink jetting portion for jetting a second ink to print on said recording medium, said second ink having an absorption coefficient (Ka) of 1.0 $ml/m^2\cdot ms^{1/2}$ or larger and a wetting time (Tw) of 20 msec or shorter;

carrying means for moving said main recording head in an axial direction of said rotary drum;

wherein said second ink jetting portion jets said second ink to print on said recording medium after at least a time Td, given by the following formula, elapses from the printing of said first ink on said recording medium;

$$Td=\{(Vd\times N+Vr-Vb)/Ka\}^2\times10^{-3}\ (\text{sec})$$

where

Vd (ml): first ink drop volume;

N: number of dots per unit area ($m^2$);

Vr $ml/m^2$: coarse index of the recording medium;

Vb $ml/m^2$: value of ink absorption rectilinear curve inclined at Ka, when T (ink contact time)=0; and Ka: the absorption coefficient of said first ink.

10. The ink jet recording apparatus according to claim 9, wherein said plurality of secondary recording heads further includes:

a third ink jetting portion for jetting a third ink to print on said recording medium, said third ink having an absorption coefficient (Ka) of 1.0 $ml/m^2\cdot ms^{1/2}$ or larger and a wetting time (Tw) of 20 msec or shorter; and a fourth ink jetting portion for jetting a fourth ink to print on said recording medium, said fourth ink having an absorption coefficient (Ka) of 1.0 $ml/m^2\cdot ms^{1/2}$ or larger and a wetting time (Tw) of 20 msec or shorter.

11. The ink jet recording apparatus according to claim 10, wherein said first ink is black, said second ink is cyan, said third ink is magenta and said fourth ink is yellow.

12. The ink jet recording apparatus according to claim 9, wherein said second ink jetting portion jets said second ink to print on said recording medium after at least a time Td, given by the following formula, elapses from the printing of said first ink on said recording medium;

$$td\{(Vd\times N+Vr-Vb)/Ka\}^2\times10^{-3}(\text{sec}),$$

where

Vd (ml): first ink drop volume;

N: number of dots per unit area ($m^2$);

Vr $ml/m^2$: coarse index of the recording medium;

Vb $ml/m^2$: value of ink absorption rectilinear curve inclined at Ka, when T (ink contact time)=0; and Ka: the absorption coefficient of said first ink.

13. The ink jet recording apparatus according to claim 9, wherein said recording medium is paper having an ash content of 2.0 to 20.0%, thickness of 75 to 120 μm, weight of 50 to 100 $g/m^2$, stoeckigt size degree of 0 to 60 sec., and degree of smoothness of 10 to 150 sec.

14. An ink jet recording apparatus according to claim 9, wherein a contact angle of the ink and said recording medium is 60° to 90°.

* * * * *